United States Patent [19]

Legendre

[11] Patent Number: 5,042,093

[45] Date of Patent: Aug. 27, 1991

[54] HEADGEAR INCLUDING AN ADJUSTABLE COIF

[75] Inventor: Jacques Legendre, Nantes, France

[73] Assignee: Comasec International SA, France

[21] Appl. No.: 425,555

[22] Filed: Oct. 23, 1989

[30] Foreign Application Priority Data

Oct. 21, 1988 [FR] France ..... 88 13848

[51] Int. Cl.[5] ..... A42B 3/00

[52] U.S. Cl. ..... 2/419; 2/197

[58] Field of Search ..... 2/419, 417, 418, 6, 2/5, 421, 197, 410

[56] References Cited

U.S. PATENT DOCUMENTS

| | | | |
|---|---|---|---|
| 631,880 | 8/1899 | Ross | 2/418 |
| 3,025,525 | 3/1962 | Larson | 2/419 |
| 3,092,837 | 6/1963 | Austin | 2/419 |
| 4,942,628 | 7/1990 | Freund | 2/417 X |

FOREIGN PATENT DOCUMENTS

| | | | |
|---|---|---|---|
| 0184528 | 6/1986 | France | 2/410 |

*Primary Examiner*—Peter Nerbun

*Attorney, Agent, or Firm*—Hill, Van Santen, Steadman & Simpson

[57] ABSTRACT

The invention relates to an adjustable coif for headgear and headgear incorporating such a coif. The simple and accurate adjustment of the coif makes it possible for several users to use the headgear, even when it supports technical equipment. The adjustable coif comprises a headband (1), a coif bottom (10), and an arrangement for adjusting the headband (1) and the coif bottom (10). The arrangement comprises a single control acting simultaneously on the headband (1) and on the coif bottom (10)

12 Claims, 5 Drawing Sheets

HEADGEAR INCLUDING AN ADJUSTABLE COIF

BACKGROUND OF THE INVENTION

The present invention relates to an adjustable coif intended for headgear and headgear incorporating such a coif.

Numerous headgear, particular headgear with a rigid structure such as protection helmets or safety hats or technical head equipment (radio equipment, gas masks, etc . . . ), must be accurately positioned on the head of the user.

In some cases, a particular coif pattern is made in different sizes. It is even sometimes necessary to adapt each coif, during manufacture thereof, to the head of the user for whom it is intended. However, the construction and management of a complete range of products is not always possible and often costly. This is why numerous headgear are equipped with an inner adjustable lining called "coif".

Such coifs are generally formed by a set of cloth or leather straps, webbing, or strips whose length may be modified by buckles or adjustable fasteners so as to adapt them to different head sizes. These coifs comprise a headband. As its name indicates, the headband is intended to be placed around the head of the user and its size is adjustable. The coif bottom is formed mainly of bands connected together and to the headband. Their size, which determines the distance between the headband and the upper portion of the head of the user, is also adjustable. To provide stability of the headgear on the head and correct positioning thereof, which is particularly important when the headgear comprises accessory equipment, the coif must be accurately adjusted. It is then suitably fitted to the shape of the head and supported without trouble by the user. Positioning of the headgear, as will be well understood, is particularly important for masks or head equipment comprising a face-piece which provides breathing protection. In fact, in these cases, the external portion of the headgear generally serves for fastening elastic straps which apply the face-piece to the face. Any modification of the headgear on the head changes the direction and value of the forces which combine to provide sealing of the face-piece.

Experience shows that the coif is generally imperfectly adjusted by users. That is due either to the complexity of the different webbing and straps forming the coif which do not permit perfect fitting to the shape of the head, or else to the fact that the successive approaches for obtaining correct adjustment both of the headband and of the coif bottom are too fastidious for the user who then makes do with an approximate adjustment.

In other cases, the complexity of adjustment leads to a form of personalization of the headgear by the user, which limits its versatility in use and thus causes an increase in the number o h and helmets required.

SUMMARY OF THE INVENTION

The problem on which the invention is based is then the design of a coif which can be simply adjusted so that it may be effectively and regularly carried out by the user.

For this, in accordance with the invention, an adjustable coif is provided intended for headgear of the type comprising a headband, a coif bottom and means for adjusting the headband and the coif bottom in which the adjustment means comprise a single control acting simultaneously on the headband and on the coif bottom.

In a preferred embodiment, in this coif which is symmetrical with respect to a plane, the headband is open, it is connected to the coif bottom at a point diametrically opposite its opening by one or more rigid fixing means. Its ends are connected to the coif bottom by adjustment means. These adjustment means comprise a bib, a slider and control means. The bib is intended to be fixed to the skull-cap of the headgear and comprises at least one approximately horizontal guide cooperating with the ends of the headband and providing horizontal guidance thereof. The slider is fixed to the coif bottom, its position, from front to rear, being defined by control means. This slider comprises two approximately rectilinear guides symmetrical with respect to the plane of symmetry of the coif and slanted with respect to the bib guides. These guides cooperate with the ends of the headband and provide positioning thereof in the horizontal plane. The control means act on the front to rear position of the slider.

The invention also relates to headgear comprising a skull-cap inside which is fixed a coif of the above indicated type.

Preferably, the coif is fixed to the headgear by the points of the headband which provide rigid fastening between the headband and the coif bottom and by the upper part of the bib cooperating with the skull-cap. It is also connected to the headband by flexible attachments.

The invention will be described in greater detail with reference to the accompanying drawings in which:

DESCRIPTION OF THE PREFERRED EMBODIMENTS

Figure 1:
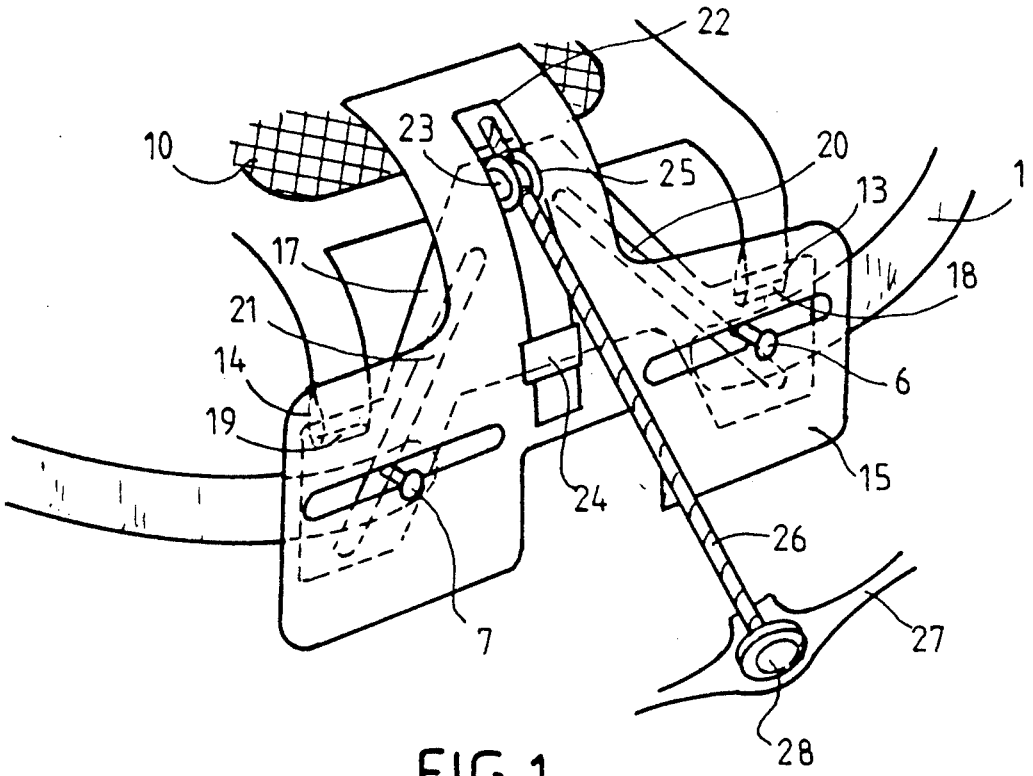
FIG. 1 is a perspective view of the device for adjusting the coif.
Figure 2:
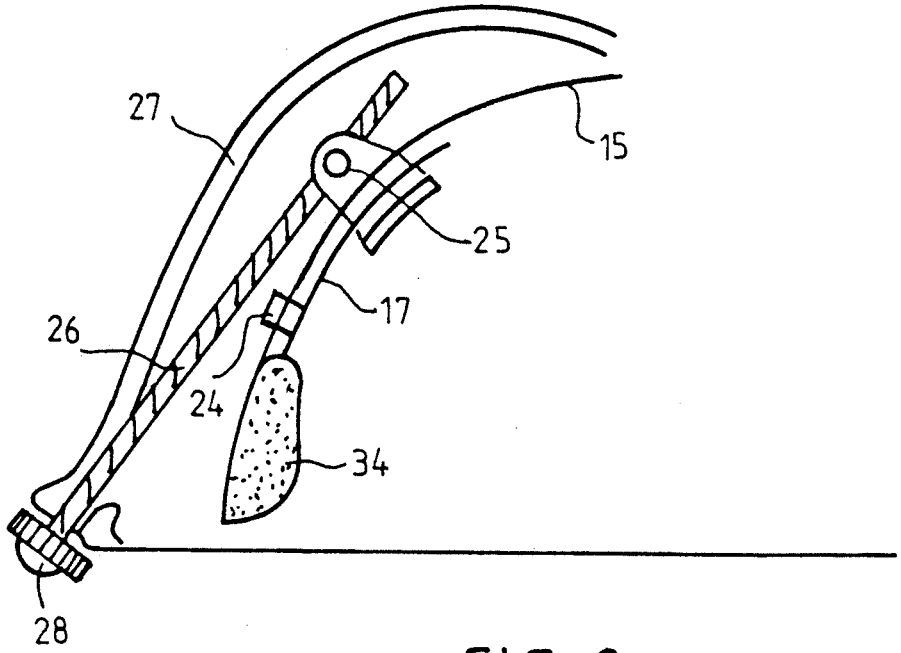
FIG. 2 is a partial sectional view of the device for adjusting the coif, positioned with respect to the headgear.
Figure 3:
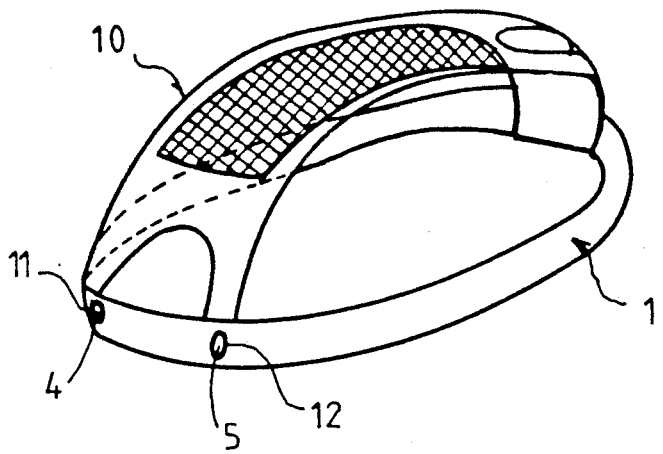
FIG. 3 is a general perspective view of the coif.
Figure 4:
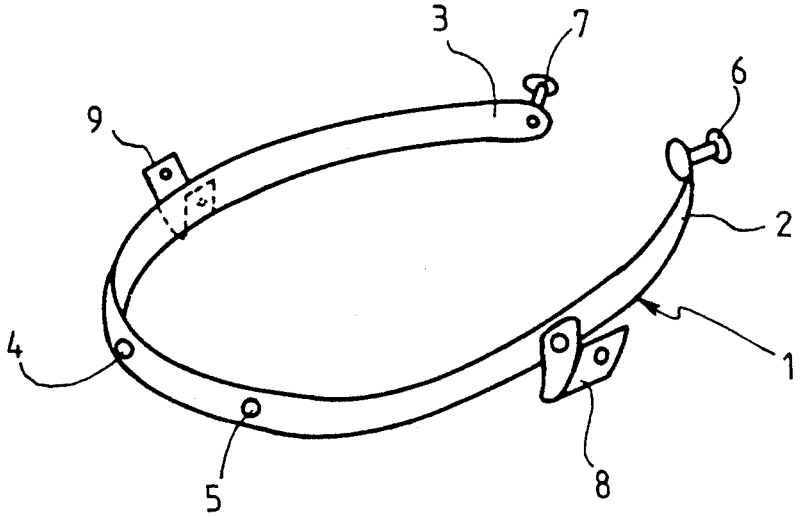
FIG. 4 shows the headband of the coif.
Figure 5:
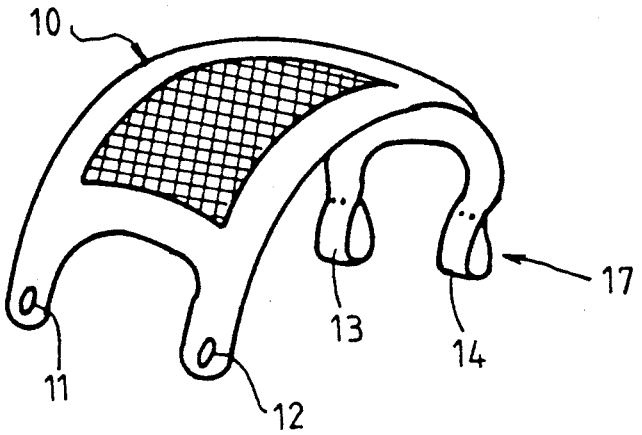
FIG. 5 shows the coif bottom.
Figure 6:
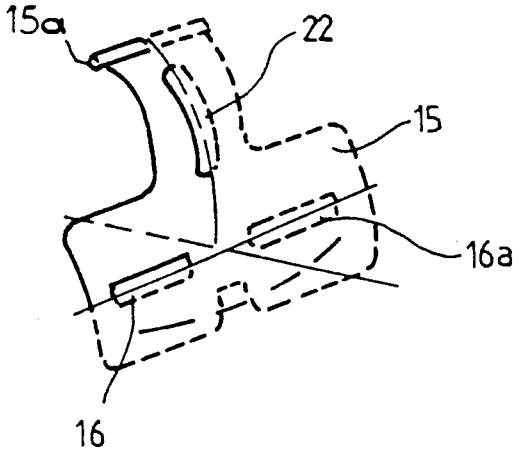
FIG. 6 is an isolated perspective view of the bib.
Figure 7:
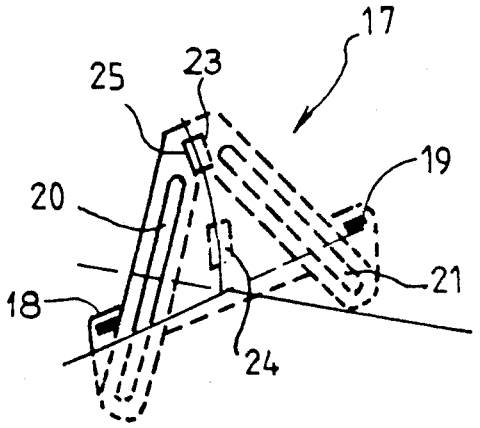
FIG. 7 is an isolated perspective view of the slider.
Figure 8:
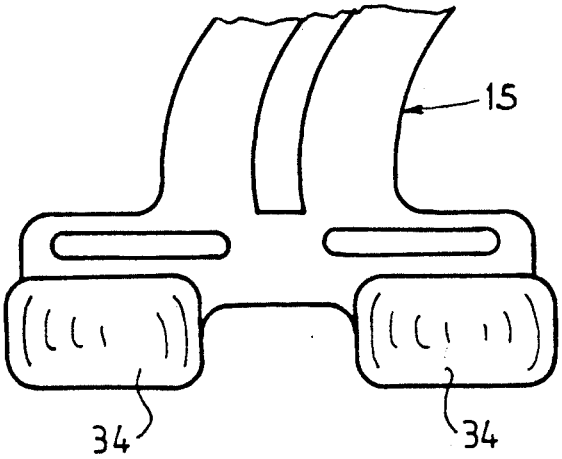
FIG. 8 is a partial perspective view of the low part of the bib, Figure

In this description, mention will be made of a plane of symmetry of the coif. It is the substantially vertical plane of symmetry of the head which quite naturally induces a plane of symmetry for any coif or headgear.

We will also use the terms "front to rear", these directions are defined with respect to the head of the subject who wears the coif or headgear, the front direction corresponding to a forward movement of the nape of the neck, the rearward direction being the opposite direction.

The coif of the invention comprises a headband 1, a coif bottom 10 and adjustment means. The headband 1 comprises a semi-rigid strip intended to surround the head of the user. It is open, i.e. it comprises two free ends 2, 3 whose relative positioning in their plane makes possible adjustment of this headband as a function of the user.

This strip is preferably padded so as to provide better comfort for the user.

It comprises two rigid fixing points 4, 5 for connection thereof, preferably at the front, with the coif bottom and with the skull-cap of the headgear.

It comprises, at its rear portion, two pins 6, 7 whose movement makes it possible to position the free ends 2, 3 of the headband and so to adjust it.

It may also comprise flexible lateral fasteners 8, 9 providing a complementary connection of this headband with the skull-cap of the headgear.

The coif bottom 10 is preferably formed by a band comprising front fixing points 11, 12 intended to cooperate with the rigid headband connections 4, 5 and so intended to be rigidly fixed to this skull-cap of the headgear. It also comprises rear fasteners 13, 14 whose front to rear positioning makes it possible to adjust the coif bottom.

This coif bottom has preferably the form of an aerated band, which provides maximum comfort for the user but it will be readily understood that, without departing from the scope of the invention, it may have numerous other forms. For this, it comprises a central net and two reinforced lateral strips.

Thus described, it will be understood that the band and the headband are rigidly connected together by their front portions and intended to be rigidly connected to the headgear. The adjustments may be obtained at the rear portion by the relative positioning of ends 2, 3 of the band, and by the front to rear positioning of the rear fasteners of the coif bottom 13, 14.

According to the invention, all these positioning operations may be carried out using a single control.

For this, the coif of the invention comprises a bib 15 intended to be connected at its upper portion 15*a* to the bottom of the skull of the headgear. This bib 15 comprises a slide 16 receiving the pins 6, 7 of the headband. This slide is preferably substantially rectilinear, perpendicular to the plane of symmetry of the coif, i.e. horizontal.

This slide is preferably formed of two portions 16, 16*a* which are symmetrical with respect to the plane of symmetry. Each of pins 6, 7 of the headband is engaged in this slide 16, 16*a*, the latter providing horizontal guidance of the free ends of band 2, 3.

The adjustment device also comprises a slider 17 connected by fastener means 18, 19 to the ends 13, 14 of the coif bottom. This slider comprises grooves 20, 21 which are symmetrical with respect to the plane of symmetry and are slanted with respect thereto. The grooves are intended to receive the pins 6, 7 of the headband, their slants being oriented so that their front tips are closer to the plane of symmetry than their rear tips.

Thus, movement of the slider from front to rear causes simultaneously tensioning of the coif bottom to which it is directly attached and by a combined action of slides 20, 21 with slides 16, 16*a* of the bib on pins 6, 7 of the headband, the latter two are drawn together, and so the headband is tensioned or reduced. The simultaneous adjustment of the headband and of the coif bottom is thus achieved.

The bib has preferably a slide 22 situated in the plane of symmetry of the coif. A slider comprises studs 23, 24 cooperating with the slide 22 so as to facilitate guidance of the slider 17 with respect to bib 15. These studs also provide relative positioning of the bib and of the slider and only allow relative rectilinear translation of one of its parts with respect to the other by sliding one over the other.

Preferably, the bib and the slider are flat semi-rigid parts.

In a preferred embodiment, the slider comprises a nut 25, for example carried by one of studs, cooperating with one of the ends of a screw 26 whose other end is intended to be connected to the bottom of the skull-cap 27 of the headgear. This latter end comprises a knob 28 accessible from outside the headgear.

Thus, rotation of screw 26, controlled by knob 28, varies the front to rear position of the slider thus acting on the tension of the coif bottom 10 to which it is connected by fasteners 13, 14. Simultaneously, the slider acting on pins 6, 7 adjusts and defines the position of the ends of the headband, namely the dimension of the latter. The action of a single control 28 therefore makes it possible to obtain simultaneous adjustment of the headband 1 and of the coif bottom 10.

It should be further noted that since knob 28 is accessible from outside the headgear, the user may very readily carry out a first adjustment before wearing the headgear then make a finer and more accurate adjustment after having placed it on his head.

Preferably, screw 26 will be flexible or semi-rigid, it may for example be made from nylon or from any other plastic material able to be threaded.

The connection between screw 26 and the bottom of skull-cap 27 allows it to rotate on itself while holding it in position. This connection is preferably articulated about an axis approximately tangential to the bottom of the skull-cap at this point so as to increase the flexibility of the coif and reduce its size inside the headgear.

Figure 11:
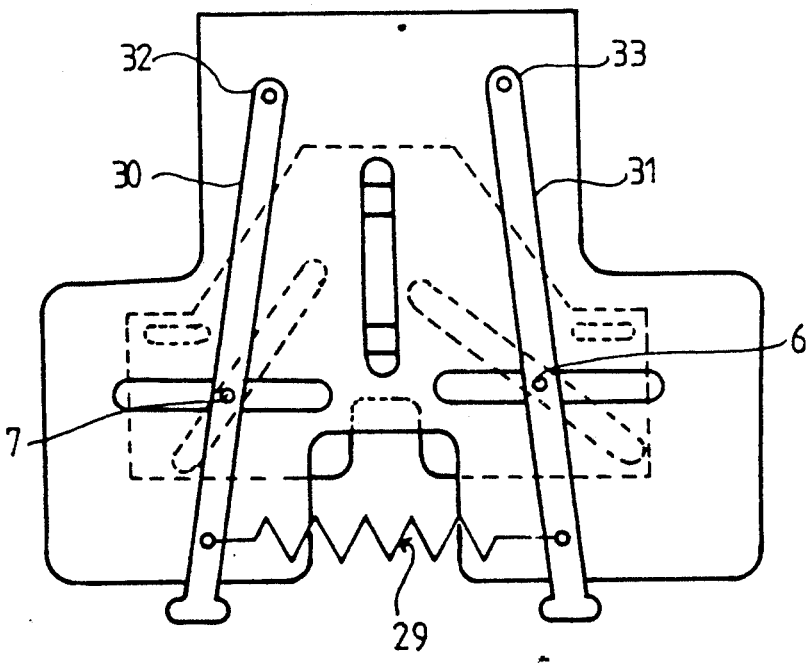
FIG. 11 shows one embodiment of the coif in which the adjustment is automatic.
Figure 10A:
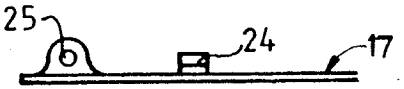
FIGS. 10 and 10A are respectively a front view and a sectional view of the slider.
Figure 10:
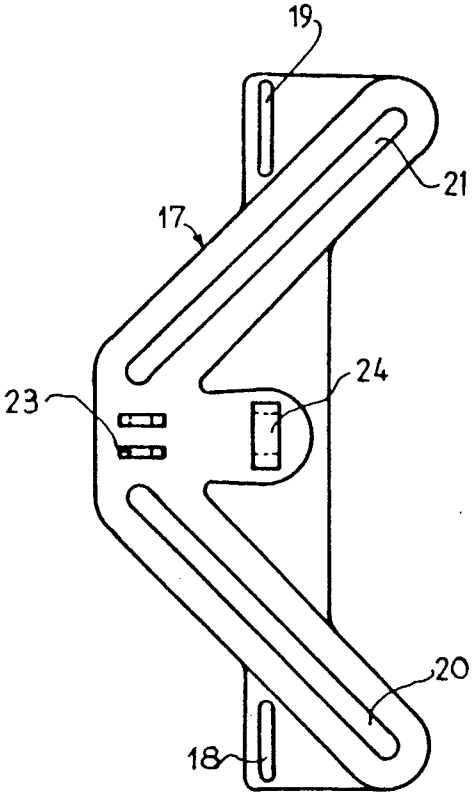
Figure 9A:
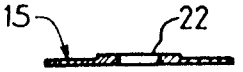
FIGS. 9 and 9A are respectively a front view and a sectional view of the bib.
Figure 9:
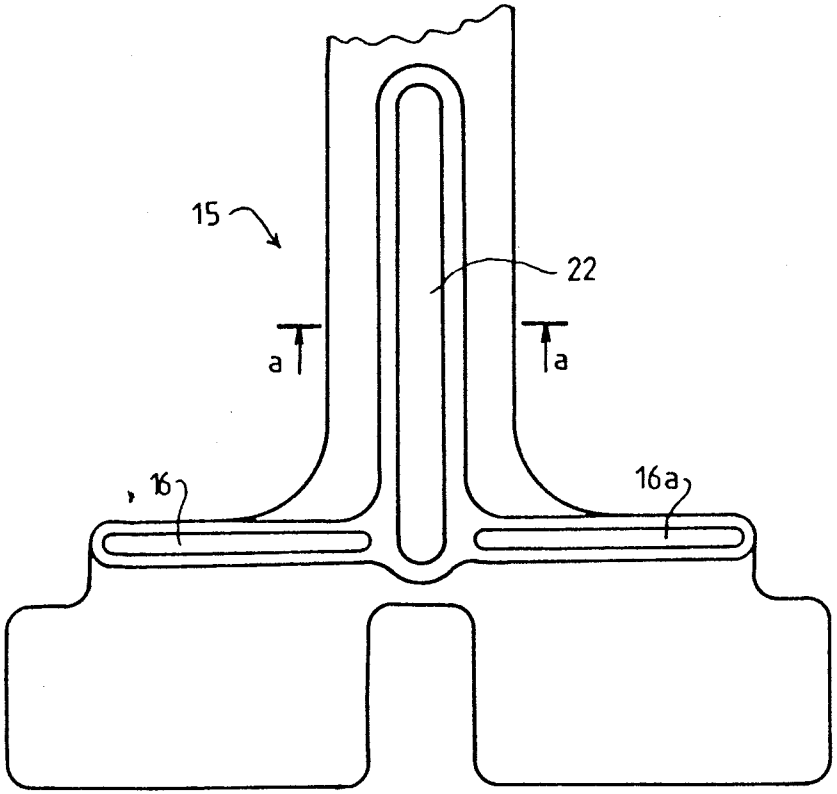

In another embodiment as shown in FIG. 11, the relative positioning of bib 15 and of slider 17 may be obtained by the action of a spring which exerts an approximately constant tension on the relative positioning of the two parts and so indirectly on the coif bottom and on the headband. Such a device therefore makes it possible to obtain, without any manual adjustment, automatic fitting of the coif to the dimensions of the head of the user.

In a particular embodiment, this return spring 29 is situated between two levers 30 and 31, which are symmetrical with respect to the axis of symmetry of the coif, each one being fast with the bib at a point 32,33 while remaining free to rotate with respect to these points and connected to pins 6, 7 of the headbanq. Since spring 29 tends to draw the lower portions of levers 30, 31 together, the tension which is exerted is transmitted both to the free ends of the headband tending to draw them together and to the rear portion of the coif bottom on which it exerts a tension.

In order to improve the comfort of the user, bib 15 comprises an adjustable cushion device 34 as shown in FIG. 12 and the headband 1 is provided with padding. These cushions are intended to be applied on the top part of the neck of the user. The coif of the invention can be used advantageously for implementing any device whose use requires positioning with respect to the head of a user. It is particularly suitable for protection devices, helmets, safety hats, gas masks, etc . . . It may also be used in the medical, optical, etc. fields for wearing any technical equipment.

I claim:

1. An adjustable coif for use in headwear having a skull-cap, comprising:

a headband having two ends defining an opening;

a coif bottom that is symmetrical relative to a plane of symmetry and has a front and rear;

at least one rigid fixing means for affixing the front of said coif bottom to said headband at a location generally opposite said opening in said headband;

means for adjusting said headband and said coif bottom, said means for adjusting being attached at the rear of said coif bottom near said plane of symmetry, said means for adjustment including:

a bib attachable to the skull-cap of the headwear, said bib including first and second approximately horizontal guides cooperating with said two ends of said headband to provide horizontal guidance of said ends, said guides being slots, a slider fixed to said coif bottom, said slider including two approximately rectilinear guides arranged symmetrically relative to said plane of symmetry and slanted relative to said horizontal guides of said bib, said two rectilinear guides cooperating with said ends of said headband and providing positioning of said ends in a horizontal plane, said rectilinear guides being slots, a single control means for acting simultaneously on said headband and said coif bottom, said control means acting to vary a front to rear position of said slider; and pins at said ends of said headband passing through said slots of said bib and said slots in said slider and able to move therein.

2. An adjustable coif according to claim 1 wherein the guides of the slider are slanted approximately at 45 degrees with respect to the guide of the bib.

3. An adjustable coif according to claim 1 wherein the guide of the bib is formed of two separate parts each cooperating with one of said two ends of the headband.

4. An adjustable coif according to claim 1, wherein the bib comprises a second guide approximately perpendicular to the guide of the ends of the headband, and the slider being guided in said second guide.

5. An adjustable coif according to claim 4, wherein the second guide of the bib is a slot.

6. An adjustable coif according to claim 1, wherein the coif bottom comprises two fasteners for fixing said coif bottom to the slider.

7. An adjustable coif according to claim 1 wherein the means for adjusting is connectable to a base of the headwear to permit adjustment of a distance between a point of connection to the base of the headwear and the slider.

8. An adjustable coif according to claim 7, wherein the means for adjusting comprises a threaded rod cooperating with a nut joined to the slider, and being intended to pass through an opening in the headgear placed at the base thereof and a knurled wheel for rotating the threaded rod from outside the headgear and thus obtaining the desired adjustment.

9. An adjustable coif according to claim 1, wherein the means for adjusting comprises levers being pivotably connected at one of their ends to the bib to be free to rotate with respect to this connection, said lever being fixed to the ends of the headband by means of the pins, and being fixed together in the vicinity of their other ends by a resilient means tending to draw these other ends together.

10. An adjustable coif according to claim 1, wherein the slider and the bib are made from a semi-rigid material.

11. An adjustable coif according to claim 1 wherein the slider and the bib are made from a plastic material and wherein the bib has, at its lower part, adjustable cushions intended to rest on a top part of a neck of a user of the headwear.

12. An adjustable coif according to claim 1, wherein the headband is formed by a semi-rigid padded band.

* * * * *